United States Patent [19]

Nilssen

[11] Patent Number: 4,463,285

[45] Date of Patent: Jul. 31, 1984

[54] DC BALLASTING MEANS FOR FLUORESCENT LAMPS

[76] Inventor: Ole K. Nilssen, Caesar Dr., Rte. 5, Barrington, Ill. 60010

[21] Appl. No.: 356,089

[22] Filed: Mar. 8, 1982

[51] Int. Cl.[3] ..... H05B 37/00; H05B 39/00; H05B 41/14

[52] U.S. Cl. ..... 315/205; 315/229; 315/DIG. 5; 315/DIG. 7

[58] Field of Search ..... 315/DIG. 2, DIG. 5, 315/DIG. 7, 200, 203, 205, 207, 229, 265, 272, 266

[56] References Cited

U.S. PATENT DOCUMENTS

| | | | |
|---|---|---|---|
| 3,353,062 | 11/1967 | Nuckolls | 315/205 |
| 3,787,751 | 1/1974 | Farrow | 315/205 |
| 3,818,268 | 6/1974 | Peltz | 315/205 |
| 3,857,063 | 12/1974 | Major et al. | 315/205 |
| 4,260,932 | 4/1981 | Johnson | 315/205 |
| 4,272,703 | 6/1981 | Eckberg | 315/205 |

*Primary Examiner*—Saxfield Chatmon

[57] ABSTRACT

A fluorescent lamp ballasting means comprises a conventional voltage doubler, which voltage doubler is adapted to operate from a regular power line AC input voltage and to supply a unidirectional output current to the fluorescent lamp. After the lamp has been started, the resulting lamp current is determined in part by the size of the capacitors used in the voltage doubler and in part by the impedance of an impedance means connected in series between the lamp and the voltage doubler.

By choosing the magnitude of the voltage doubler capacitors such as to constitute the major lamp-current-determining factor, a relatively good overall systems efficacy is obtained.

Lamp starting is aided by capacitively coupling the input AC voltage to the lamp in a fashion additive to the DC voltage provided by the voltage doubler—this DC voltage being coupled to the lamp by way of a rectifying means. As a result, the peak lamp starting voltage is equal to four times the peak voltage of the input AC voltage. Yet, by accomplishing the coupling of the AC voltage to the DC voltage by way of one of the lamp's pairs of terminal pins, the coupling only occurs when the lamp is present in its sockets; which implies that the open circuit socket voltages are maintained at relatively low and safe levels.

Additional lamp starting aid is provided by establishing an AC voltage field between the fluorescent lamp and a starting aid electrode placed in close proximity to the lamp.

9 Claims, 4 Drawing Figures

DC BALLASTING MEANS FOR FLUORESCENT LAMPS

BACKGROUND OF THE INVENTION

1. Field of the Invention

The present invention relates to ballasting means for fluorescent lamps, particularly of the kind that operates on regular household AC voltage but wherein the lamp is supplied with direct current.

2. Cross-Reference to Related Application

The present patent application is related to a previous patent application of mine entitled "Electric Insect Trap", Ser. No. 155,002, filed May 30, 1980.

3. Description of Prior Art

DC ballasting means for fluorescent lamps presently do exist. However, such ballasts are impractical for application in most regular commercial usage situations.

One significant difficulty associated with the practical application of existing types of DC ballasting means is that of the extremely high voltages required for effective lamp starting, which high voltages pose special problems in regard to designing safe lighting fixtures.

For instance, DC ballasting is used in a so-called Shop-Light manufactured by Lights of America, City of Industry, CA 91745; and in that Shop-Light the socket-to-socket voltage provided for each of the two F40/T12 fluorescent lamps therein used is over 900 Volt peak, which compares with less than 300 Volt peak in case of similar Shop-Lights using regular AC ballasts.

SUMMARY OF THE INVENTION

Objects of the Invention

A first object of the present invention is that of providing a DC fluorescent lamp ballasting means in which the lamp socket voltages are maintained at relatively low and safe levels.

A second object is that of providing a fluorescent lamp ballasting means in which the lamp is principally operated on DC, but where an AC voltage is used for achieving improved lamp starting.

A third object is that of providing a particularly cost-effectively fluorescent lamp ballasting means.

These and yet additional objects, features and advantages of the present invention will become apparent from the following description and claims.

Brief Description

The present invention relates to fluorescent lamp ballasting means capable of starting and operating most ordinary fluorescent lamps—providing these lamps with current-limited DC voltage derived by way of a voltage doubler from a regular household AC voltage source.

In its preferred embodiment, the ballasting means consists of an ordinary voltage doubler circuit, the DC output of which is coupled to a fluorescent lamp through an impedance means and by way of an arrangement for adding an AC voltage as well as a second DC voltage to this original voltage doubler DC output voltage as it is applied to the lamp.

Typically, when powered from a regular 120 Volt AC power line, the voltage doubler circuit provides about 340 Volt DC across its output. This DC output voltage is applied through a rectifier to the series combination of the fluorescent lamp and an impedance means. From the AC input voltage, by way of a coupling capacitor, the AC input voltage is applied to the fluorescent lamp at the same point at which the voltage doubler DC voltage is applied through a rectifier. As a result, the total effective peak voltage applied across the fluorescent lamp, prior to lamp ignition, is equal to four times the peak magnitude of the AC input voltage—or about 680 Volt with 120 Volt AC input.

To prevent this relatively high lamp starting voltage from appearing at the lamp socket terminals whenever the lamp is removed therefrom, means are provided whereby the coupling of the AC voltage with the DC voltage only takes place after the lamp is inserted into its socket.

The voltage doubler consists of two oppositely polarized single-wave rectifier-capacitor combinations. The output voltage is taken between the positive-voltage terminal of the one capacitor and the negative-voltage terminal of the other capacitor—with the remaining two capacitor terminals being connected together. Thus, as long as only a relatively small current is drawn from the capacitors, the net DC voltage output equals twice the peak amplitude of the AC input voltage.

The capacitance values of the capacitors are chosen such that the average DC voltage available from the voltage doubler is significantly affected by the current drawn: being about 340 Volt at no load, but falling to significantly lower levels after the lamp has been started. For instance, for a typical F40/T12 fluorescent lamp, the lamp operating voltage after starting is about 100 Volt; which implies—if such a lamp is being powered directly from such a voltage doubler—that the voltage provided by the voltage doubler should fall from about 340 Volt before lamp ignition to about 100 Volt after lamp ignition.

While the net effective internal impedance of the voltage doubler circuit in-and-of-itself could be used as the only means for limiting the lamp current, this is not generally desirable to do in that it results in a highly undesirable lamp current crest factor.

To provide for an improved lamp current crest factor, a small amount of resistive and/or inductive impedance is provided in series connection with the lamp. While a plain resistor is useful for this purpose, an inductor can provide for even better crest factor improvement as well as improved overall efficiency.

DESCRIPTION OF THE PREFERRED EMBODIMENT

Figure 1:
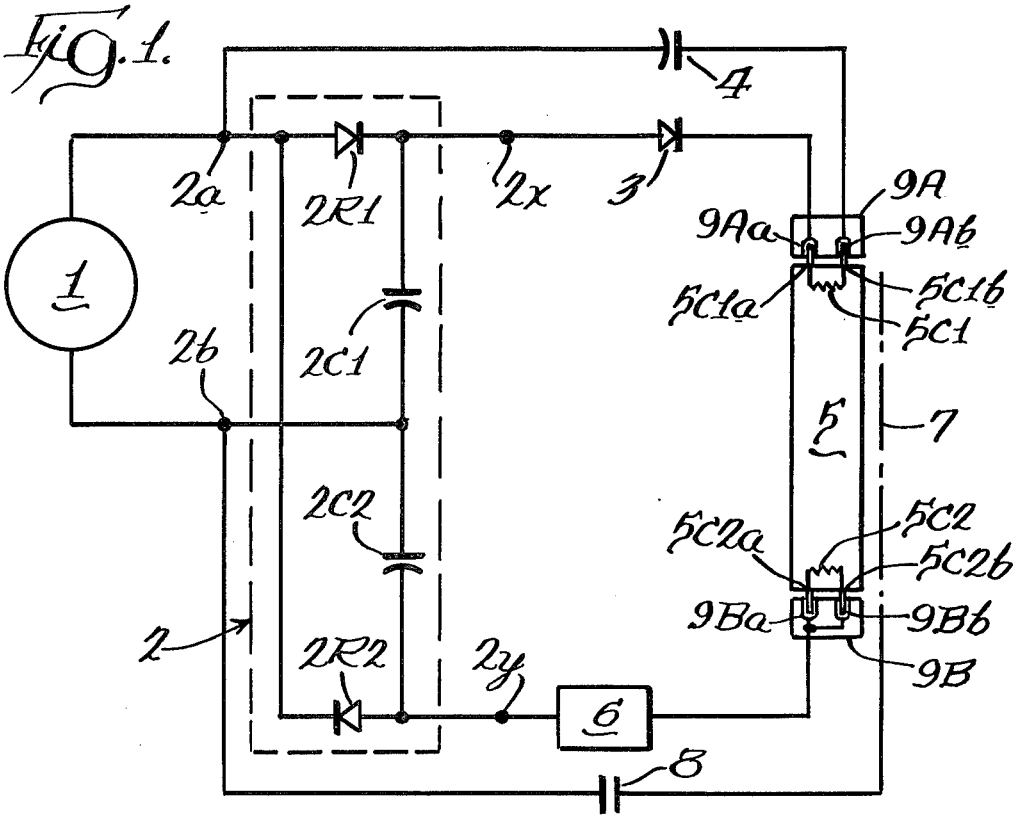
FIG. 1 shows a schematic circuit diagram of the preferred embodiment of the invention as adapted to operate a single fluorescent lamp.

The preferred embodiment of the present invention is schematically illustrated in FIG. 1.

Shown in FIG. 1 is a source 1 of AC voltage, which source may be an ordinary household electric power receptacle. The outut from source 1 is applied to the two input terminals 2*a* and 2*b* of a voltage doubler 2. The output from this voltage doubler is provided across output terminals 2*x* and 2*y*, of which terminal 2*x* is connected to the anode of a rectifier 3. The cathode of rectifier 3 is connected with socket terminal 9Aa of lamp socket 9A. Socket terminal 9Ab of socket 9A is connected to input terminal 2*a* by way of capacitor 4.

A regular four-terminal fluorescent lamp 5 has two cathodes 5C1 and 5C2. Cathode 5C1 has two cathode terminals 5C1*a* and 5C1*b*; cathode 5C2 similarly has two cathode terminals 5C2*a* and 5C2*b*.

The lamp is removably placed in sockets 9A and 9B such that cathode terminal 5C1*a* is disconnectably connected with socket terminal 9Aa, cathode terminal 5C1*b* is similarly connected with socket terminal 9Ab, and cathode terminals 5C2*a* and 5C2*b* are similarly connected with socket terminals 9Ba and 9Bb.

Cathode terminals 5C1*a* and 5C1*b* are connected together inside lamp 5 by way of cathode 5C1. Cathode terminals 5C2*a* and 5C2*b* are similarly connected together inside lamp 5 by way of cathode 5C2.

Socket terminals 9Ba and 9Bb are connected together to one of the terminals of an impedance means 6. The other terminal of impedance means 6 is connected to output terminal 2*y* of the voltage doubler.

The voltage doubler circuit consists of a rectifier 2R1 connected with its anode to input terminal 2*a* and with its cathode to output terminal 2*x*. A capacitor 2C1 is connected between output terminal 2*x* and input terminal 2*b*, and a capacitor 2C2 is connected between output terminal 2*y* and input terminal 2*b*. Another rectifier 2R2 is connected with its anode to output terminal 2*y* and with its cathode to input terminal 2*a*.

A lamp starting electrode 7 is placed adjacent to lamp 5 and connected with input terminal 2*b* through a capacitor 8.

Figure 2:
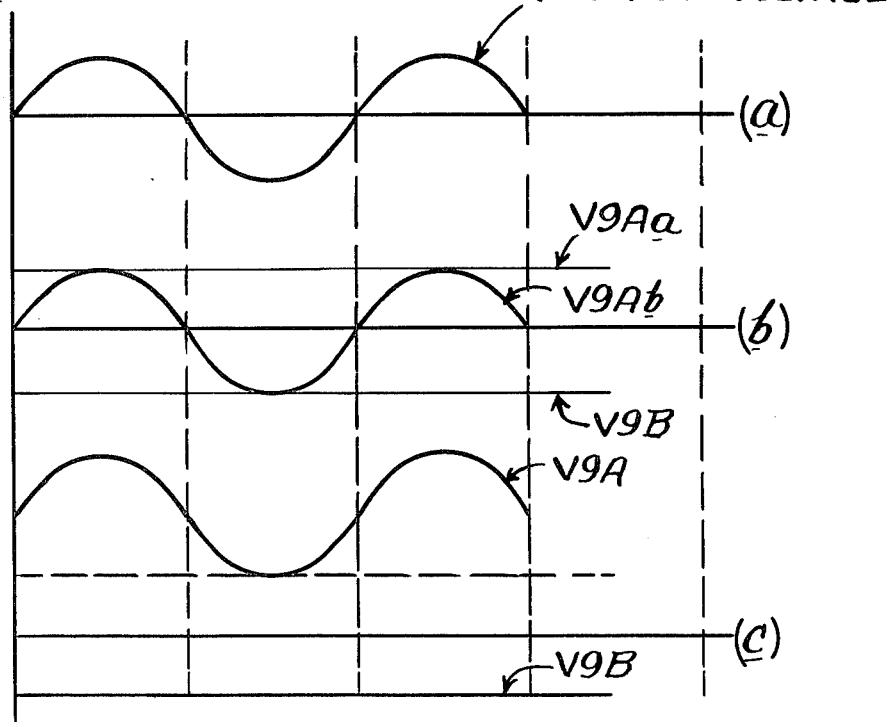
FIG. 2 shows the voltage waveforms present at different points in the circuit of FIG. 1—with the lamp in or out of its sockets.

Using input terminal 2*b* as a reference, FIG. 2 illustrates voltage waveforms at different places in the circuit of FIG. 1.

FIG. 2(*a*) shows the voltage present at terminal 2*a* (i.e., the AC input voltage).

FIG. 2(*b*) shows various voltages as they exist with the fluorescent lamp removed from its terminals: the voltage present at socket terminal 9Aa is indicated as V9Aa; the voltage present on socket terminals 9Ba and 9Bb is indicated as V9B; and the voltage present on socket terminal 9Ab is indicated as V9Ab.

FIG. 2(*c*) shows the various voltages as they exist with the lamp present in its sockets, but before the lamp has ignited: the voltage present at socket terminals 9Aa and 9Ab (these terminals now being connected together) is indicated as V9A; the voltage present on socket terminals 9Ba and 9Bb is the same as in FIG. 2(*b*) and is indicated as V9B.

With references to FIG. 2, the operation of the preferred embodiment of FIG. 1 may be explained as follows.

In a manner well known in the art, when supplied with an AC voltage at its input terminals 2*a* and 2*b*, the voltage doubler circuit provides a DC voltage across its output terminals 2*x* and 2*y*—with 2*x* being the positive terminal. As long as the current drawn from the output of the voltage doubler is relatively small, this DC voltage will be of a magnitude that is about twice that of the peak amplitude of the AC voltage applied at its input. Thus, with 120 Volt AC applied at its input, the output voltage across terminals 2*x* and 2*y* will be about 340 Volt DC as long as no significant output current is being drawn—which is the case prior to lamp starting.

Considering input terminal 2*b* as a reference, a positive DC voltage is applied from terminal 2*x* through rectifier 3 to terminal 9Aa of socket 9A and a negative DC voltage is applied from terminal 2*y* through impedance means 6 to socket terminals 9Ba and 9Bb. The input AC voltage is applied through capacitor 4 from input terminal 2*a* to terminal 9Ab of socket 9A.

With an AC voltage of 120 Volt applied across input terminals 2*a* and 2*b*, and without the lamp inserted into its sockets 9A and 9B, the socket terminals will have the voltages indicated in FIG. 2(*b*). Relative to input terminal 2*b*, these voltages will have the following magnitudes: socket terminal 9Aa will have a positive DC voltage of about 170 Volt (i.e., equal to the peak magnitude of the AC input voltage); socket terminal 9Ab will have an AC voltage of 120 Volt AC; and socket terminals 9Ba and 9Bb, being connected together, will both have a negative DC voltage of about 170 Volt.

With the lamp inserted into its sockets 9A and 9B but before the lamp ignites, the various voltages will now be as indicated in FIG. 2(*c*) and—again with reference to input terminal 2*b*—with magnitudes as follows: by virtue of the connection path provided by lamp cathode 5C1, socket terminals 9Aa and 9Ab will now both have the same voltage, which voltage will consist of a positive DC component of about 340 Volt (i.e., equal to about two times the peak amplitude of the 120 Volt AC input voltage) and an AC component of 120 Volt; socket terminals 9Ba and 9Bb will still have a negative DC voltage of about 170 Volt.

Thus, with the lamp inserted into its sockets, but before lamp ignition occurs, the net effective voltage present between lamp cathodes 5C1 and 5C2, which voltage is illustrated in FIG. 2(*c*) as the difference between voltages V9A and V9B, amounts to a total of about 510 Volt DC to which is added an AC voltage of 120 Volt, this addition yielding a peak voltage of 680 Volt.

The starting aid electrode 7 is a strip of conductive material placed adjacent to and alongside the lamp. This strip should preferably be of a width equal to or wider than the diameter of the fluorescent lamp and should be present along the full length of the lamp, with a separation from the lamp of no more than about 0.25 inch. In fact, the starting aid electrode may simply be a structural part of the lighting fixture itself.

This starting aid electrode is connected to the input reference terminal 2*b* through a capacitor 8, thereby establishing the full input AC voltage between the starting aid electrode and one of the lamp's cathodes.

Since the current associated with such a starting aid electrode is very low, being in the region of microAmperes, the capacitance value of this capacitor may be very small. (If permitted from a safety viewpoint, the capacitor may be eliminated altogether and substituted with a direct connection between the starting aid electrode and input terminal 2*b*.)

The function of the starting aid electrode is that of causing a small amount of lamp pre-ionization, thereby pre-conditioning the lamp to start more readily with the voltage provided between its cathodes. This pre-ionization is generated by the relatively high AC field strength generated between the starting aid electrode on the one hand and, on the other hand, one of the lamp's cathodes (cathode 5C2 in this case) and, subsequently, an ionization path emanating from this cathode.

With the indicated starting aid and the relatively high peak voltage present between the lamp's cathodes, the ballast circuit of FIG. 1 will effectively start and operate a wide variety of common fluorescent lamps—even without using any cathode pre-heating. That is, the lamp will instant-start.

However, to avoid a so-called hang-up in the glow discharge region, it is important that the effective impedance from which the indicated high starting voltage is provided (i.e., the 640 Volt peak in this case) is adequately small.

Once started, the lamps will draw current from the voltage doubler circuit, and the net DC output voltage will then decrease in magnitude—the amount of decrease being dependent on the capacitance of capacitors 2C1 and 2C2 as well as on the amount of current drawn.

The function of the impedance means 6 in series with the fluorescent lamp is twofold: first, without a series impedance means other than that provided by the effective output impedance of the voltage doubler circuit, the resulting lamp current would have a very poor crest factor (due to the fact that the internal impedance of the voltage doubler is capacitive in nature), which would cause severe lamp life foreshortening in addition to poor lamp efficiency and very pronounced light flicker; and, second, to the extent that the impedance means is at least partly resistive in nature, it helps limit and stabilize the lamp current.

In actual practice, the sizing of capacitors 2C1, 2C2, and 4, as well as of impedance means 6, is accomplished as a compromise between overall luminous efficacy effectiveness of lamp starting, lamp life, amount of light output, light output regulation, and manufacturing cost.

In an application adapted to be operable with the most common type of all fluorescent lamps, namely the 40 Watt/48" lamp, the component parts of the circuit arrangement of FIG. 1 are characterized as follows:

| | |
|---|---|
| Lamp 5 | F40/T12; |
| Source 1 | 120 Volt, 60 Hz; |
| Impedance means 6 | 150 Ohm, 20 Watt; |
| Rectifiers 2R1, 2R2 and 3 | 1N4004; |
| Capacitors 2C1 and 2C2 | 12 uF, 160 Volt; |
| Capacitor 4 | 1 uF, 350 Volt; |
| Capacitor 8 | 10 nF, 500 Volt. |

In respect to the circuit of FIG. 1, it is noted that a certain simple circuit modification may be provided for—a modification which would noticably improve the electrical circuit function, although it would in most cases introduce a not insignificant manufacturing cost penalty. In particular, by providing an external means for heating lamp cathode 5C2 (the negative lamp electrode), the lamp can be started in the rapid-start or in the pre-heat mode, which implies a substantial improvement in lamp life expectancy as compared with operating the lamp in the instant-start mode.

For instance, cathode 5C2 may be heated by way of a small transformer means connected with its primary winding across input terminals 2*a* and 2*b* and with its secondary windings connected across lamp socket terminals 9Ba and 9Bb in lieu of the indicated short circuit therebetween.

If such external cathode heating is provided for, the lamp can be effectively started with lower voltages applied across the lamp; and, in most cases then, capacitor 4 may be eliminated and replaced with an open circuit, and rectifier 3 may be eliminated and replaced with a short circuit.

Figure 3:
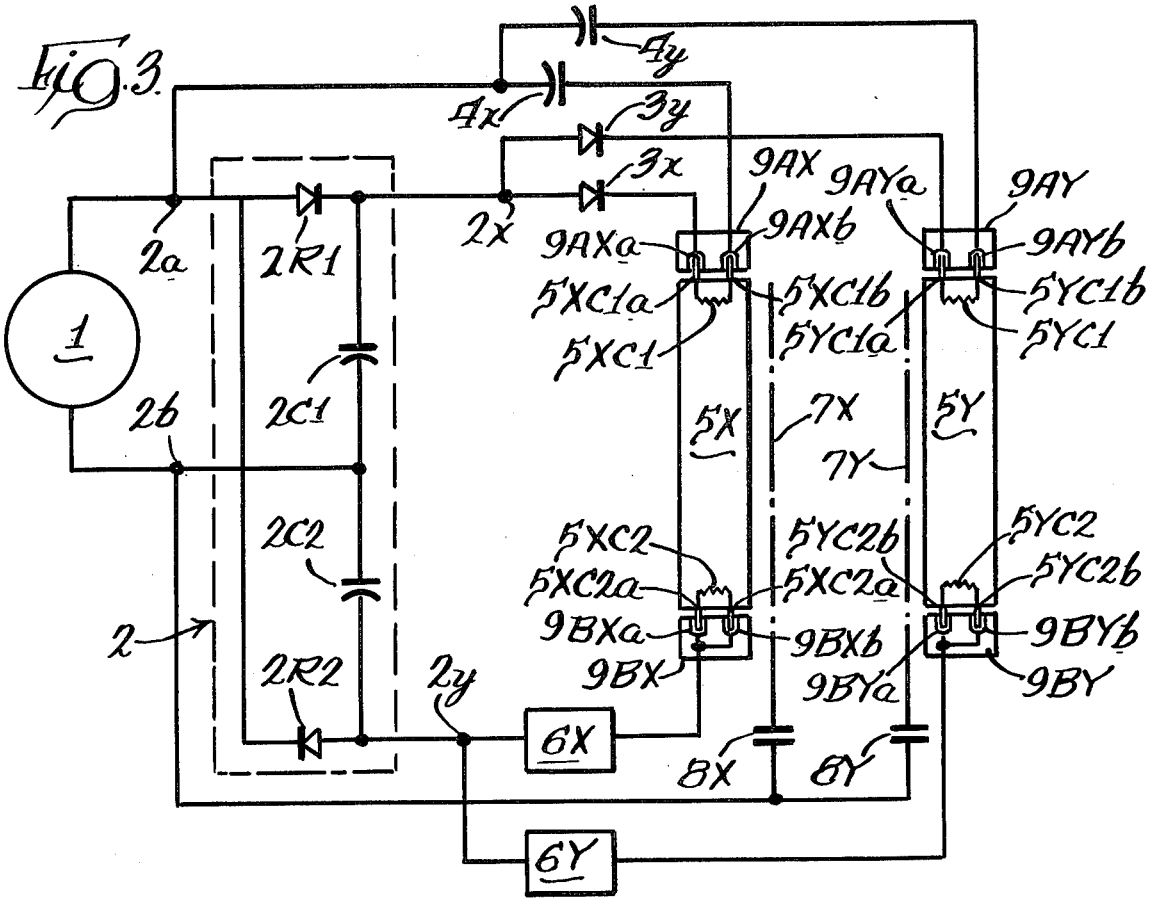
FIG. 3 shows the preferred embodiment of the invention as adapted for parallel operation of two fluorescent lamps.

FIG. 3 illustrates how the basic ballasting principle of FIG. 1 can be adapted to operate more than just a single fluorescent lamp.

The front part of the circuit of FIG. 3—the part from and including source 1 and up to and including the voltage doubler output terminals 2*a* and 2*b*—is identical to the corresponding front part of FIG. 1.

The remainder of the circuit of FIG. 1—the part following the output terminals 2*a* and 2*b*—is simply replicated twice in the arrangement of FIG. 3, with the letters X and Y used to indicate replication 1 and 2, respectively.

The two starting aid electrodes 7X and 7Y may be combined into a single common starting aid electrode for both lamps, in which case capacitors 8X and 8Y may likewise be combined into a single capacitor.

In the arrangement of FIG. 3 versus that of FIG. 1, it is generally advantageous to provide a larger part of the lamp-current-limiting function by way of the lamp series impedance means (i.e., 6A and 6B) as compared with providing it by way of the output impedance of the voltage doubler. The reason for this is that fluorescent lamps are of a negative-resistance nature, and—if connected in parallel—will not operate in a stable manner. (Only one lamp would light if they were connected directly in parallel.) Thus, it is necessary that a degree of electrical isolation be provided between the two lamps; and such electrical isolation is achieved by way of providing for separate and relatively large series impedance means.

Figure 4:
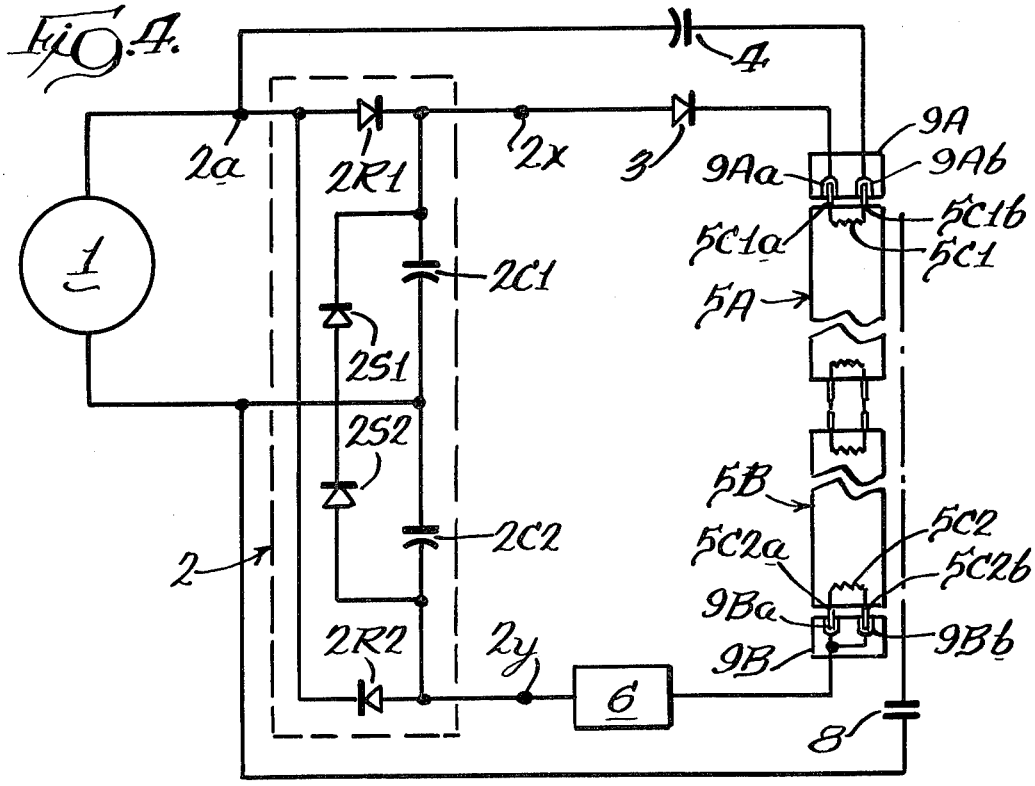
FIG. 4 shows how the principles of the invention may be adapted to operate two series-connected fluorescent lamps.

FIG. 4 illustrates how the circuit of FIG. 1 applies to a situation where two fluorescent lamps are connected in series.

Except as indicated in the next sentence, the circuit of FIG. 4 is identical to that of FIG. 1—and the various components are identified by the same alpha-numeric designations as in FIG. 1. The only differences are: (a) that lamp 5 has been directly substituted with two series-connected fluorescent lamps 5A and 5B, and (b) that capacitors 2C1 and 2C2 have been provided with shunting rectifiers 2S1 and 2S2, respectively.

The principal reason for including the shunting rectifiers is that of bringing attention to the fact that capacitors 2C1 and 2C2—in any of the circuits of FIGS. 1, 2 and/or 3—may be electrolytic capacitors; in which case the shunting rectifiers prevent reverse voltages from appearing across the capacitors, thereby serving to prevent severe foreshortening of capacitor life expectancy.

It is noted that the circuits of FIGS. 1, 2 and/or 3 may be simplified under some circumstances: namely in cases where the fluorescent lamp is relatively easy to start, which most often implies cases where relatively short fluorescent lamps are used. In such cases, even if the lamp is operated in the instant-start mode, capacitor 4 may be eliminated and replaced with an open-circuit; and rectifier 3 may be eliminated and replaced with a short-circuit. However, the starting aid electrode should still be used.

In cases where a still higher voltage than about 680 Volt peak (assuming 120 Volt AC input voltage) is required for effective lamp starting and/or operation, it is simply possible to provide for additional voltage doubling stages. Still, however, it is advantageous to employ the principle of using AC voltage as aid in making the lamp(s) start.

It is believed that the present invention and many of its attendant advantages and features will be understood from the preceeding description. However, without departing from the spirit of the invention, many changes may be made in its form and/or in the construction of its component parts; the form herein presented merely representing its preferred embodiment.

I claim:

1. A ballasting means for a fluorescent lamp having a first and a second cathode, each cathode having a first and a second input terminal, said ballasting means being adapted to operate from an AC voltage and comprising:

a pair of ballast input terminals adapted to connect with said AC voltage, a source for providing a unidirectional voltage across a pair of DC output terminals whenever said ballast input terminals are connected with said AC voltage, a diode means having a first and a second terminal, said second terminal being connected with said first input terminal of said first cathode, means for connecting one of said pair of DC output terminals to the first terminal of said diode means, and the other one of said pair of DC output terminals to one of the input terminals of said second cathode, and capacitor means connected between one of said ballast input terminals and the second input terminal of said first cathode, whereby, if a break occurs in the connection between said first and second terminal of said first cathode, the magnitude of the voltage attained at said first terminal is reduced in comparison with that of the voltage present before said break occurs.

2. The ballasting means of claim 1 wherein a starting aid electrode is disposed adjacent the fluorescent lamp, said starting aid electrode being connected in circuit with said source of AC voltage.

3. The ballasting means of claim 1 comprising an impedance means connected in series-circuit between said pair of DC output terminals and the fluorescent lamp cathode input terminals.

4. The ballasting means of claim 1 wherein said source of unidirectional voltage comprises a pair of energy storing capacitors.

5. The ballasting means of claim 4 wherein said energy storing capacitors comprise electrolytic capacitors.

6. The ballasting means of claim 5 wherein said electrolytic capacitors are each shunted with a diode means thereby preventing reverse voltages from developing across said electrolytic capacitors.

7. A ballasting means for a gas discharge lamp, said lamp having a first and a second cathode, each cathode having a first and a second connection terminal, said ballasting means being adapted to operate from a source of AC voltage and comprising:

a pair of ballast input terminals adapted to connect with said source of AC voltage, a first series-combination of a first rectifier and a first capacitor, said first series-combination being connected across said pair of input terminals, said first rectifier having its cathode connected with one terminal of said first capacitor at a first junction, a second series-combination of a second rectifier and a second capacitor, said second series-combination being connected across said pair of input terminals, said second rectifier having its anode connected with one terminal of said second capacitor at a second junction, first means connecting said first junction with the first terminal of said first cathode, said first means comprising an auxiliary rectifier means operative to permit current to flow in only one direction from said first junction, second means connecting the second junction with the first terminal of said second cathode, and auxiliary capacitor means connected in circuit between one of said ballast input terminals and one of the terminals of said first cathode.

8. The ballasting means of claim 7 wherein the capacitance value of said first capacitor is approximately equal to that of said second capacitor, and wherein the capacitance value of said auxiliary capacitor means is substantially smaller than that of said first or second capacitor.

9. A system for operating a fluorescent lamp, said lamp having two cathodes, each cathode having a pair of cathode input terminals, said system adapted to be powered from a source of AC voltage and comprising:

a pair of system input terminals connectable with said source of AC voltage, a first and a second lamp holder, said lamp holders adapted to receive and releaseably hold said fluorescent lamp by way of its cathode input terminals, each lamp holder having a first and a second connection means adapted to make contact with said cathode input terminals;

a first series-combination of a first rectifier and a first capacitor, said first series-combination being connected across said pair of system input terminals, said first rectifier having its cathode connected with one terminal of said first capacitor at a first junction, a second series-combination of a second rectifier and a second capacitor, said second series-combination being connected across said pair of system input terminals, said second rectifier having its anode connected with one terminal of said second capacitor at a second junction, first means connecting said first junction with the first connection means of said first lamp holder, said first means being operative to permit current to flow between said first junction and the first connection means of said first lamp holder in but one direction, second means connecting said second junction with the first connection means of said second lamp holder, and auxiliary capacitor means connected in circuit between one of said system input terminals and one of the connection means of said first lamp holder.

* * * * *